US008049693B2

(12) United States Patent
Nose et al.

(10) Patent No.: US 8,049,693 B2
(45) Date of Patent: Nov. 1, 2011

(54) DISPLAY ELEMENT, METHOD FOR DRIVING THE SAME, AND INFORMATION DISPLAY SYSTEM INCLUDING THE SAME

(75) Inventors: Masaki Nose, Kawasaki (JP); Toshiaki Yoshihara, Kawasaki (JP); Tomohisa Shingai, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 966 days.

(21) Appl. No.: 11/967,359

(22) Filed: Dec. 31, 2007

(65) Prior Publication Data

US 2008/0100552 A1 May 1, 2008

Related U.S. Application Data

(63) Continuation of application No. PCT/JP2005/012236, filed on Jul. 1, 2005.

(51) Int. Cl.
*G09G 3/36* (2006.01)

(52) U.S. Cl. ..... 345/87; 345/211

(58) Field of Classification Search ..... 345/87–107, 345/204, 211

See application file for complete search history.

(56) References Cited

U.S. PATENT DOCUMENTS

| | | | | |
|---|---|---|---|---|
| 5,390,293 | A | 2/1995 | Nishioka et al. | |
| 7,019,737 | B1 * | 3/2006 | Asai et al. | 345/211 |
| 2002/0000984 | A1 | 1/2002 | Asai et al. | |
| 2002/0015016 | A1 * | 2/2002 | Kudo et al. | 345/87 |
| 2002/0167500 | A1 | 11/2002 | Gelbman | |
| 2003/0052873 | A1 * | 3/2003 | Ueda | 345/211 |
| 2005/0243051 | A1 | 11/2005 | Kudo et al. | |
| 2006/0176410 | A1 * | 8/2006 | Nose et al. | 349/1 |

FOREIGN PATENT DOCUMENTS

| | | | |
|---|---|---|---|
| EP | 1296309 | A2 | 3/2003 |
| JP | 2001-285467 | A | 10/2001 |
| JP | 2002-108308 | A | 4/2002 |
| JP | 3089912 | U | 8/2002 |
| JP | 2003-066413 | A | 3/2003 |
| JP | 2004-102840 | A | 4/2004 |
| JP | 2005-20076 | A | 1/2005 |
| JP | 2005-020076 | A | 1/2005 |
| JP | 2005-031344 | A | 2/2005 |

OTHER PUBLICATIONS

International Search Report of PCT/JP2005/012236, date of mailing Aug. 9, 2005.

European Search Report dated Mar. 3, 2010, issued in corresponding European Patent Application No. 05765295.0.

* cited by examiner

*Primary Examiner* — Jimmy H Nguyen

(74) *Attorney, Agent, or Firm* — Westerman, Hattori, Daniels & Adrian, LLP

(57) ABSTRACT

The invention relates to a display element, an element drive method, and an information display system having the element, and has an object to provide a display element capable of stably acting even if a received electric power reduces, a method for driving the element, and an information display system having the element. The system comprises: a display section having laminated display layers; a wireless transmitting/receiving section for receiving electric waves containing the display data of the display layers; a driving voltage generating circuit for generating drive voltages to drive the display layers from the electric waves received; and a control section for simultaneously driving the display layers of the number which is determined on the basis of the receiving situations of the electric waves.

16 Claims, 10 Drawing Sheets

FIG.6A
FIG.6B
FIG.6C
FIG.6D
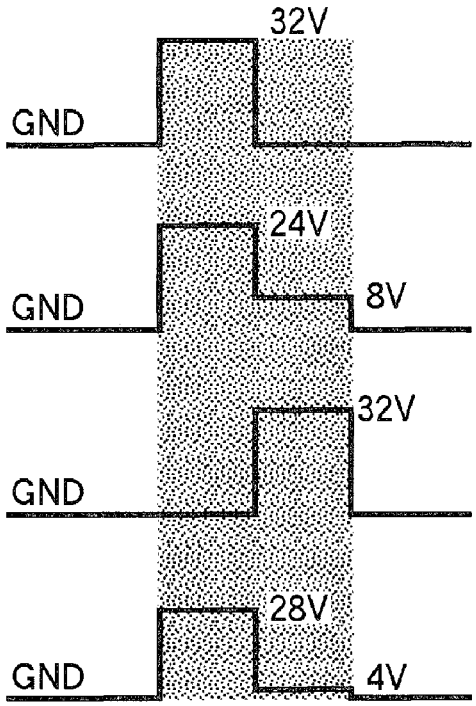
FIG.7A
FIG.7B
FIG.7C
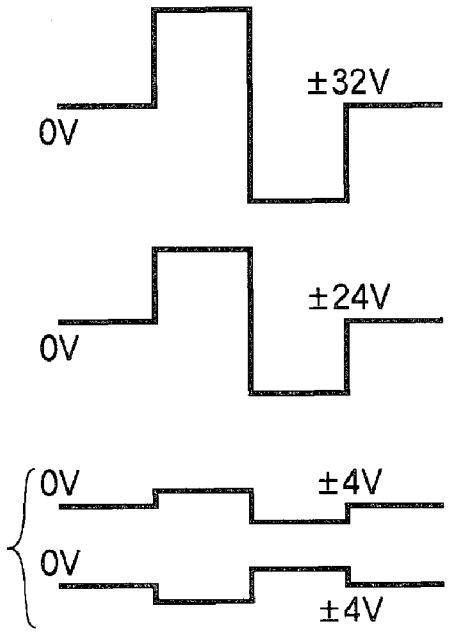

BLUE LAYER

GREEN LAYER
RED LAYER

DISPLAY ELEMENT, METHOD FOR DRIVING THE SAME, AND INFORMATION DISPLAY SYSTEM INCLUDING THE SAME

This application is a continuation of International Application No. PCT/JP2005/012236, filed Jul. 1, 2005.

BACKGROUND OF THE INVENTION

1. Field of the Invention

The present invention relates to a display element, a method for driving the same, and an information display system including the same.

2. Description of the Related Art

Recently, development of electronic paper is active in enterprises and universities. Promising applications of electronic paper include electronic books first of all, sub-displays of mobile terminals, and display portions of IC card. Writing of electronic paper on a wireless basis is studied as a promising applied technique of electronic paper. Existing interfaces available for wireless writing include wireless LANs, Bluetooth (a registered trademark), and contactless IC card systems. When a wireless LAN or Bluetooth is used, electronic paper must be provided with a battery. In the case of a contactless IC card system, data in an IC card are read and written using electric waves transmitted from a reader/writer as a temporary power source. Since the field strength is several tens of milliwatt, the use of a contactless IC card system can make it possible to provide a wireless and battery-less driving system in which electronic paper is written for display without providing it with a battery.

Display elements advantageously used in electronic paper include display elements using a cholesteric liquid crystal. Display elements using a cholesteric liquid crystal allows a reduction in power consumption which is a prerequisite for a wireless and battery-less driving system because they have memory characteristics to allow display to be held semi-permanently. Display elements using a cholesteric liquid crystal also have excellent characteristics, i.e., high color display characteristics which allow vivid display of colors, high contrast, and high resolution. A cholesteric liquid crystal can be obtaining by adding a relatively large amount (several tens %) of a chiral additive (chiral material) to a nematic liquid crystal, and it is therefore sometimes called a chiral nematic liquid crystal. A cholesteric liquid crystal forms a cholesteric phase in which molecules of the nematic liquid crystal are helically (spirally) aligned.

A display element using a cholesteric liquid crystal displays is enabled for display by controlling the state of alignment of liquid crystal molecules. States of alignment of a cholesteric liquid crystal include a planer state in which incident light is reflected and a focal conic state in which incident light is transmitted. Those states exist with stability even when there is no electric field. A liquid crystal layer in the focal conic state transmits light, and a liquid crystal layer in the planar state selectively reflects light having particular wavelengths in accordance with the helical pitch of liquid crystal molecules.

FIG. 12A schematically shows a configuration of a common liquid crystal display element, and FIG. 12B schematically shows a configuration of a liquid crystal display element using a cholesteric liquid crystal. As shown in FIG. 12A, a common liquid crystal display element has one liquid crystal display layer 101 in which pixels of red (R), green (G), and blue (B) are arranged side by side. On the contrary, as shown in FIG. 12B, a liquid crystal display element using a cholesteric liquid crystal generally has a structure formed by stacking three liquid crystal display layers 101R, 101G, and 101B in which pixels of the colors R, G, and B are provided, respectively. The liquid crystal display layers 101R, 101G, and 101B are enabled for display of the colors R, G, and B by varying the helical pitch of liquid crystal molecules. A liquid crystal display element using a cholesteric liquid crystal has an aperture ratio which is about three times greater than that of a common liquid crystal display element. A liquid crystal display element using a cholesteric liquid crystal is therefore capable of color display with high brightness because it has light utilization efficiency (reflectance) that is about three times higher than that of a common liquid crystal display element.

Patent Document 1: Japanese Utility Model No. 3089912

Patent Document 2: JP-A-2003-66413

Patent Document 3: JP-A-2002-108308

However, a liquid crystal display element for color display using a cholesteric liquid crystal suffers from a significant increase in power consumption when display is rewritten because it has a structure formed by stacking three monochromatic liquid crystal display elements and requires a driving voltage of ten and a few V or more. In the case of a wireless and battery-less driving system using feeble electric waves as power, an increase in a communication distance results in a reduction in receiving power. Therefore, a liquid crystal display element employing a wireless and battery-less driving system has a problem in that it is liable to operational failures attributable to shortage of power.

SUMMARY OF THE INVENTION

According to one aspect, there is a display element including a display section stacking a plurality of display layers, a wireless transmitting/receiving section for receiving electric waves including display data of the plurality of display layers, a driving voltage generating section generating a driving voltage for driving the display layers from the received electric waves, and a control section simultaneously driving the display layers in a number of layers determined based on the state of reception of the electric wave using the driving voltage.

According to another aspect, there is a display element including a display section stacking a plurality of display layers, a wireless transmitting/receiving section receiving electric waves including display data of the plurality of display layers, a driving voltage generating section generating a driving voltage for driving the display layers from the received electric waves, and a control section driving the display layers using the driving voltage at a scanning speed determined based on the state of reception of the electric waves.

Further, according to another aspect, there is a display element driving method for driving a display element having a display section wherein a plurality of display layers are stacked based on electronic waves received from outside, the display element driving method including generating a driving voltage driving the display layers from the received electric waves and driving the display layers which are simultaneously driven by the driving voltage in a number of layers determined based on the state of reception of the electric waves.

Further, according to another aspect, there is a display information transmitting apparatus including a wireless transmitting/receiving section transmitting electric waves to a display element having a display section wherein a plurality of display layers are stacked and receiving data on the state of reception of the electric waves from the display element and a control section generating transmission data to be transmitted to the display element based on the reception state data.

Further, according to another aspect, there is an information display system including a display element having a display section stacking a plurality of display layers, a wireless transmitting/receiving section receiving electric waves including display data for the plurality of display layers and transmitting data on the state of reception of the electric waves, a driving voltage generating section generating a driving voltage for driving the display layers from the received electric waves, and a control section for driving the display layers in a predetermined number of layers simultaneously using the driving voltage; and a display information transmitting apparatus having a wireless transmitting/receiving section for transmitting the electric waves to the display element and receiving the reception state data from the display element and a control section for generating transmission data to be transmitted to the display element based on the reception state data.

BRIEF DESCRIPTION OF THE DRAWINGS

FIGS. 6A to 6D are diagrams showing voltage waveforms applied to scanning electrodes and signal electrodes;

FIGS. 7A to 7C are diagrams showing voltage waveforms applied to liquid crystal layers;

DESCRIPTION OF THE PREFERRED EMBODIMENTS

Figure 1:
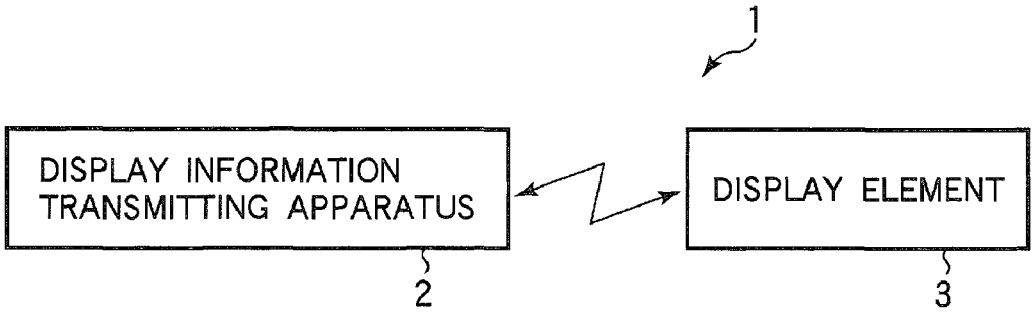
FIG. 1 is a diagram schematically showing a configuration of a information display system in a mode for carrying out the invention.

A display element, a method of driving the same, and an information display system including the same in a mode for carrying out the invention will now be described with reference to FIGS. 1 to 11B. FIG. 1 is a block diagram schematically showing a configuration of the information display system in the present mode for carrying out the invention. As shown in FIG. 1, an information display system 1 includes a display information transmitting apparatus 2 which transmits predetermined display information on a wireless basis and a display element 3 which can receive the display information transmitted on a wireless basis to perform display based on the display information. The display information transmitting apparatus 2 and the display element 3 can communicate with each other according to a wireless communication standard such as ISO/IEC18092 which is a communication method for contactless IC cards of the proximity type (for communication distances on the order of 10 cm). The communication may be made according to other wireless communication standards including those for contactless IC cards of the close-contact type (for communication distances on the order of 2 mm), the vicinity type (for communication distances on the order of 1 m), and the distant type (for communication distances on the order of several meters) and those used for communication methods other than contactless IC cards. A clock signal CLK, display data, a driver control signal, and the like are transmitted from the display information transmitting apparatus 2 to the display element 3. The display element 3 includes no battery and uses electric waves from the display information transmitting apparatus 2 as a power source. A driving circuit of the display element 3 is activated upon receipt of the clock signal. After the driving circuit receives the display data and the driver control signal, the driving circuit transfers them to driving circuit for the display layers.

Figure 2:
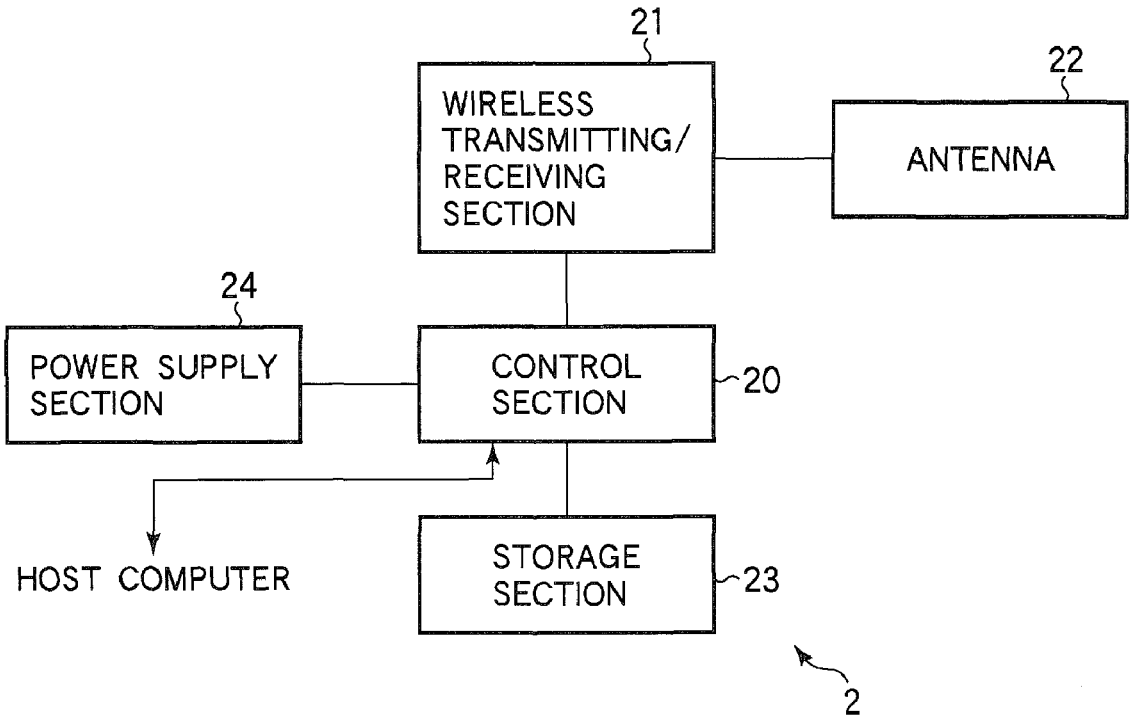
FIG. 2 is a block diagram showing a configuration of a display information transmitting apparatus in the mode for carrying out the invention.

FIG. 2 is a block diagram showing a configuration of the display information transmitting apparatus 2 in the present mode for carrying out the invention. As shown in FIG. 2, the display information transmitting apparatus 2 includes a control section 20 for controlling each circuit in the apparatus and a power supply section 24 for supplying power to each circuit. A wireless transmitting/receiving section 21 is connected to the control section 20. The wireless transmitting/receiving section 21 communicates with the outside through an antenna 22 on a wireless basis. A storage section 23 is connected to the control section 20. The storage section 23 includes a ROM in which predetermined programs and data are stored and a RAM in which data are temporarily stored. The control section 20 transmits and receives various types of information to and from a host computer.

Figure 3:
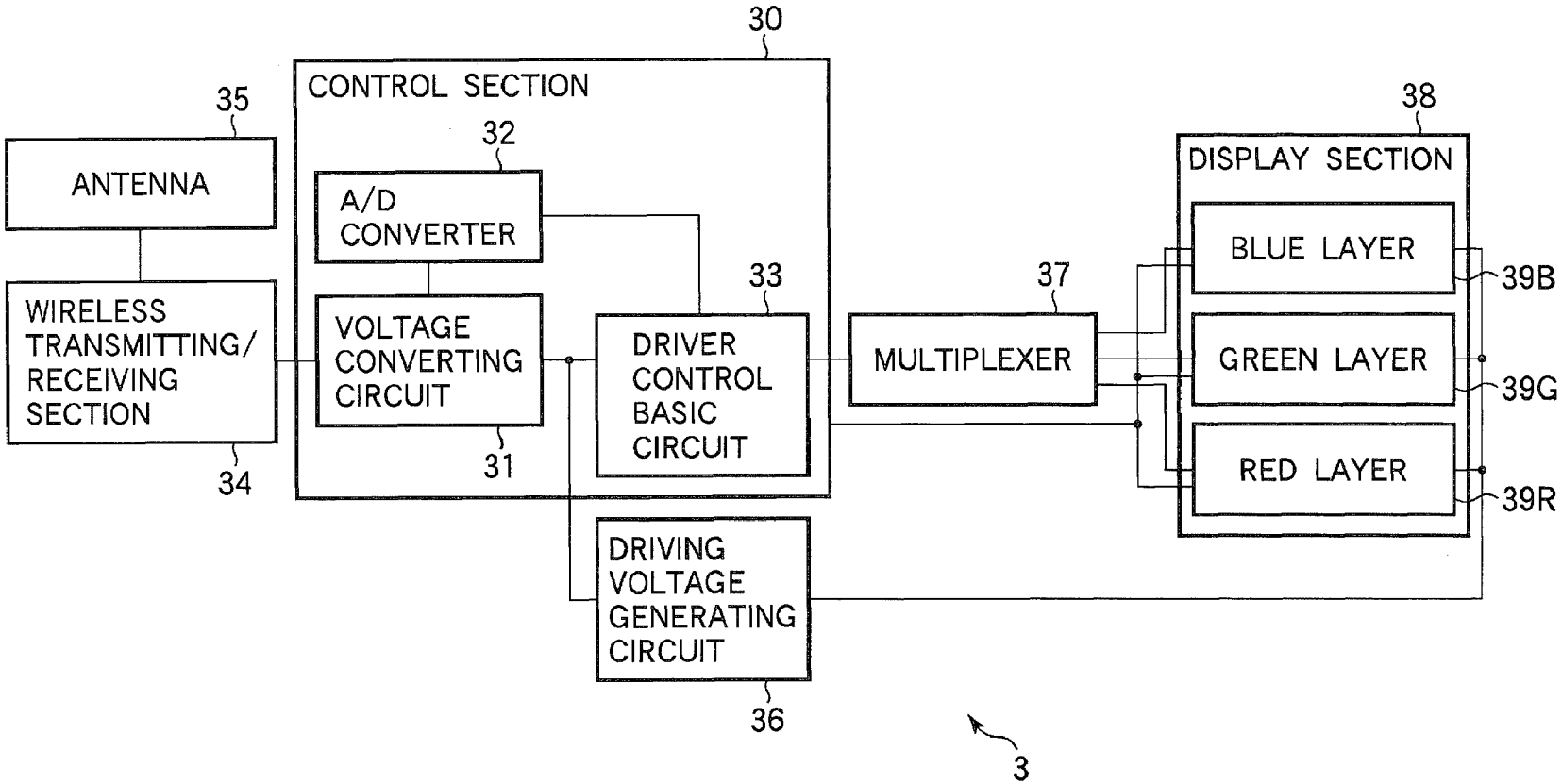
FIG. 3 is a block diagram shown a configuration of a display element in the mode for carrying out the invention.

FIG. 3 is a block diagram showing a configuration of the display element 3 in the present mode for carrying out the invention. As shown in FIG. 3, the display element 3 includes a wireless transmitting/receiving section 34 for communicating with the radio transmitting/receiving section 21 of the display information transmitting apparatus 2 on a wireless basis through an antenna 35, a control section 30 for controlling each circuit in the display element 3, and a display section 38 provided by stacking a display layer (red layer) 39R for displaying red (R), a display layer (green layer) 39G for displaying green (G), and a display layer (blue layer) 39B for displaying blue (B). The display layers 39R, 39G, and 39B are provided with, for example, a general-purpose STN driver and are driven using the simple matrix driving method. The display element 3 does not include a non-volatile memory.

The control section 30 also has the function of determining the state of reception of electric waves from outside. A voltage converting circuit 31 of the control section 30 generates a voltage from received electric waves. An A/D converter 32 converts the voltage level generated by the voltage converting circuit 31 into a digital signal to generate received voltage data. A driver control basic circuit 33 determines the state of reception of the electric waves based on the received voltage data to determine the number of layers that can be simultaneously driven among the display layers 39R, 39G, and 39B. The driver control basic circuit 33 also controls a driver for controlling a display layer 39 (39R, 39G or 39B) selected by a multiplexer 37. The voltage converting circuit 31 is connected with a driving voltage generating circuit 36 which includes a rectifying section and a stabilizing section and which generates driving voltages at a plurality of levels for driving the display layers 39R, 39G, and 39B.

The display section 38 will now be described. When wireless and battery-less driving is performed as in the present mode for carrying out the invention, it is considered that liquid crystal display layers employing cholesteric liquid crystals are preferably used as the display layers of the display section 38. The first reason is that liquid crystal display layers using cholesteric liquid crystals have memory characteristics. For this reason, display data which have been once written at each pixel are maintained without performing periodic writing thereafter. Since writing can therefore be performed at a low speed, power consumption is small, and most of the weak received power can be concentrated to a pixel that is being scanned.

The second reason is that a cholesteric liquid crystal has a high specific resistance and therefore results in low current consumption. For example, it is difficult to use battery-less driving for an organic EL display, an electro-luminescence display or the like which is driven by a current.

Stable states of alignment of a cholesteric liquid crystal include a planar state in which incident light is reflected and a focal conic state in which incident light is transmitted. A liquid crystal layer in the focal conic state transmits light, and a liquid crystal layer in the planar state selectively reflects light having particular wavelength according to the helical pitch of the liquid crystal molecules. A center wavelength $\lambda$ of light selectively reflected by a liquid crystal layer in the planar state is expressed by the following equation where n represents an average refractive index of the liquid crystal and p represents the helical pitch.

$$\lambda = n \cdot p$$

A reflection bandwidth $\Delta\lambda$ increases with increase in refractive index anisotropy $\Delta n$ of the liquid crystal. Black can be displayed when the liquid crystal is in the focal conic state by providing a light absorbing layer that is separate from the liquid crystal layer.

When a voltage is applied to a cholesteric liquid crystal to generate a strong electric field, the helical structure of liquid crystal molecules is completely decomposed, and the state of alignment of the liquid crystal changes to a homeotropic state in which the directions of the longer axes of all molecules follow direction of the electric field. When the electric field is abruptly removed from the liquid crystal in the homeotropic state, the helical axis of the liquid crystal becomes perpendicular to the electrodes. Thus, the planar state is entered, in which light having wavelength according to the helical pitch are selectively reflected. When a relatively weak electric field such that the helical structure of liquid crystal molecules is not completely decomposed is generated in a cholesteric liquid crystal and is thereafter removed or when a strong electric field is generated and is thereafter slowly removed, the helical axis of the liquid crystal becomes parallel to the electrodes. Thus, the focal conic state is entered, in which incident light is transmitted. When an electric field having an intermediate intensity is generated and is abruptly removed thereafter, the alignment of the liquid crystal enters a state which is a mixture of the planar state and the focal conic state. In this state, halftones can be displayed. A display element employing a cholesteric liquid crystal displays information by taking advantage of those phenomena.

Figure 4:
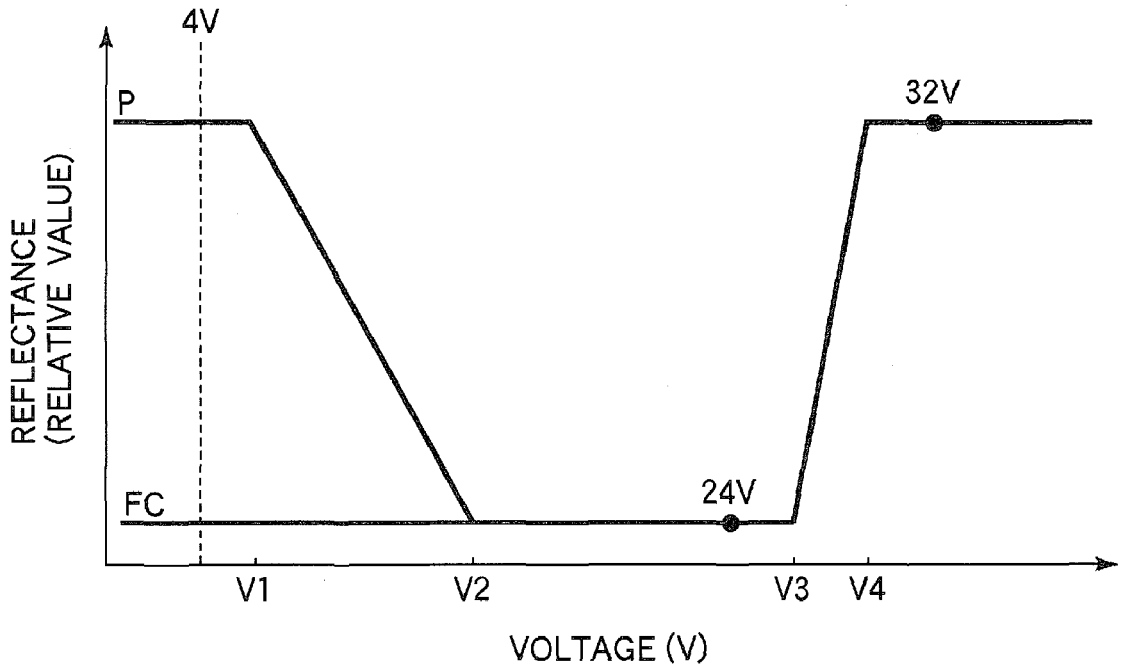
FIG. 4 is a graph showing voltage response characteristics of a cholesteric liquid crystal.

FIG. 4 is a graph showing voltage response characteristics of a cholesteric liquid crystal. The abscissa axis of the graph represents the magnitudes (V) of pulse voltages applied to a liquid crystal layer, and the ordinate axis represents light reflectance (relative values) of the liquid crystal layer after the application of the pulse voltages. The state in which the reflectance is relatively high represents the planar state (P), and the state in which the reflectance is relatively low represents the focal conic state (FC). As shown in FIG. 4, when the magnitude of a pulse voltage applied is V1 or less (e.g., 4 V), the alignment of the liquid crystal is kept in the planar state if initial state has been the planar state. If the initial state is the focal conic state, the focal conic state is maintained.

Let us assume that the initial state of the liquid crystal alignment is the planar state. Then, the state of alignment changes to the focal conic state when a somewhat high pulse voltage (for example, about 24 V) which is not lower than V2 and not higher than V3 (V1<V2<V3) is applied, and the alignment is kept in the planar state when a higher pulse voltage (for example, about 32 V) which is equal to or higher than V4 (V3<V4) is applied. When the initial state of the liquid crystal alignment is the focal conic state, the alignment is kept in the focal conic state even if a pulse voltage which is not lower than V2 and not higher than V3 is applied, and the state of alignment changes to the planar state in response to the application of a pulse voltage equal to or higher than V4. That is, whether the initial state of the liquid crystal alignment is the planar state or the focal conic state, the range of pulse voltages not lower than V2 and not higher than V3 constitutes a driving band toward the focal conic state, and pulse voltages equal to or higher than V4 constitute a driving band toward the planar state.

Figure 5:
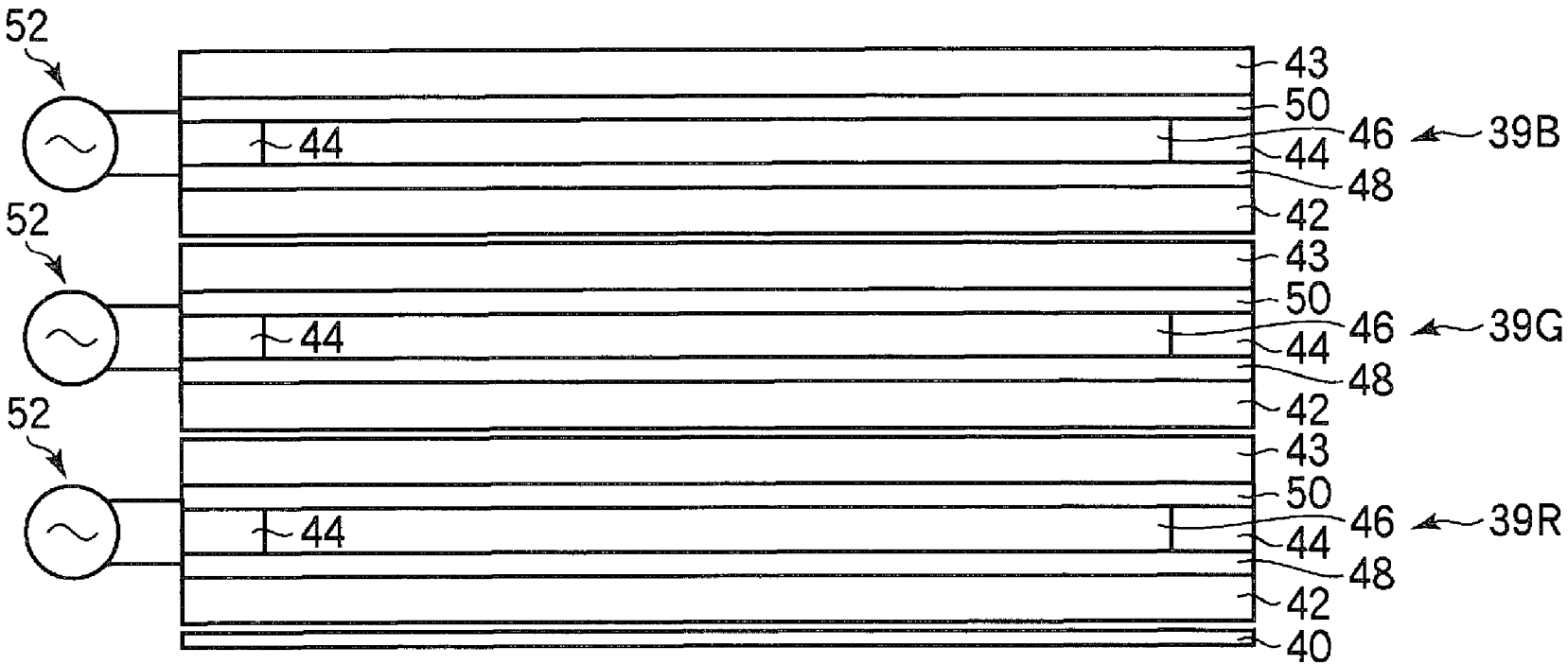
FIG. 5 is a sectional view schematically showing a configuration of a display section of the display element in the mode for carrying out the invention.

FIG. 5 schematically shows a sectional configuration of the display section 38 using a cholesteric liquid crystal. As shown in FIG. 5, the three display layers 39B, 39G, and 39R included in the display section 38 have a pair of glass substrates 42 and 43 combined with each other with a seal material 44 interposed between them. For example, both of the glass substrates 42 and 43 have translucency to allow visible light to pass. Film substrates using polyethylene terephthalate (PET), polycarbonate (PC) or the like may be employed instead of the glass substrates 42 and 43.

A plurality of scanning electrodes 48 in the form of stripes extending substantially in parallel with each other are formed on a surface of the glass substrate 42 facing the glass substrate 43. A plurality of signal electrodes 50 in the form of stripes extending substantially in parallel with each other are formed on a surface of the glass substrate 43 facing the glass substrate 42. When the display layer is of the Q-VGA type, for example, 240 scanning electrodes 48 and 320 signal electrodes 50 are formed. The scanning electrodes 48 and the signal electrodes 50 extend to intersect each other in a view of the same taken perpendicularly to substrate surfaces. The scanning electrodes 48 and the signal electrodes 50 are formed using, for example, an indium tin oxide (ITO). The scanning electrodes 48 and the signal electrodes 50 may alternatively be formed using transparent conductive films made of an indium zinc oxide (IZO) or the like, or metal electrodes made of aluminum, silicon or the like, or photoconductive films made of amorphous silicon, a bismuth silicon oxide (BSO) or the like.

The scanning electrodes 48 and the signal electrodes 50 are preferably coated with insulating thin films or alignment stabilizing films. The insulating thin films have the function of improving the reliability of the liquid crystal display layer by preventing shorting between the electrodes and serving as gas barrier layers to block gas components. Organic films made of a polyimide resin, polyimideamide resin, a polyetherimide resin, a polyvinylbutylal resin, an acryl resin or the like may be used as the alignment stabilizing films, and an inorganic material such as a silicon oxide or aluminum oxide may alternatively be used. In this example, the scanning electrodes 48 and the signal electrodes 50 are coated with alignment stabilizing films. The alignment stabilizing films may also serve as the insulating thin films.

Spacers for maintaining a uniform cell gap are provided between the glass substrates 42 and 43. The spacers used may be spherical spacers made of a resin or an inorganic oxide, fixed spacers coated with a thermoplastic resin on the surface thereof, or pillar spacers formed on the substrates using a photolithographic process.

A cholesteric liquid crystal composition exhibiting a cholesteric phase at room temperature is enclosed between the glass substrates 42 and 43 to form a liquid crystal layer 46. The cholesteric liquid crystal composition is made by adding 10 to 40 wt % chiral material to a nematic liquid crystal mixture. The amount of chiral material added is a value on an assumption that the total amount of the nematic liquid crystal and the chiral material corresponds to 100 wt %. When the amount of chiral material added is large, the molecules of the nematic liquid crystal are strongly twisted. Thus, the helical pitch becomes small, and light having short wavelengths is selectively reflected. Conversely, when the amount of chiral material added is small, the helical pitch becomes long, and light having long wavelengths is selectively reflected. Various known materials may be used as the nematic liquid crystal. Dielectric constant anisotropy $\Delta\in$ of 20 or more is preferred from the viewpoint of the driving voltage. The driving voltage is relatively low when the dielectric constant anisotropy $\Delta\in$ is 20 or more. The cholesteric liquid crystal composition added with a chiral material preferably has dielectric constant anisotropy of 20 to 50. Further, it preferably has refractive index anisotropy $\Delta n$ of 0.18 to 0.24. When the refractive index anisotropy $\Delta n$ is smaller than that range, reflectance in the planar state is reduced. When the refractive index anisotropy $\Delta n$ is greater than the range conversely, significant scattered reflection occurs in the focal conic state, and viscosity undesirably increases to result in a longer response time. The liquid crystal layer preferably has a thickness (cell thickness) of about 3 to 6 μm. When the call thickness is smaller than this range, reflectance in the planar state is reduced. A thickness greater than the range results in an increase in the driving voltage.

The display section of the display element in the present mode for carrying out the invention has a configuration in which three display layers 39B, 39G, and 39R for selectively reflecting light of B, G, and R, respectively in the planar state are stacked in the order listed starting at the viewer's side (the top side of FIG. 5). A visible light absorbing layer 40 is provided as occasion demands on the side of the display layer 39R opposite to the viewer's side (the bottom side of FIG. 5). All of the display layers 39B, 39G, and 39R have a cell gap of 5 μm. The liquid crystal layers 46 of the display layers 39B, 39G, and 39R are formed by the same nematic liquid crystal and chiral matrial, and the chiral material is added in different amounts such that light rays having different wavelengths are selectively reflected.

Each of the display layers 39B, 39G, and 39R has a driving circuit 52 for applying pulse voltages to the scanning electrodes 48 and the signal electrodes 50. General-purpose STN driver ICs are used in the driving circuit 52. For example, two STN driver ICs having 160 outputs are used on the scanning side, and an STN driver IC having 240 outputs is used on the signal side. Zener diodes are used to stabilize voltages input to the driver ICs. Although the voltages may be stabilized using operational amplifiers, Zener diodes are preferred in the case of wireless driving from the view point of power saving. Driving voltages at a plurality of levels generated by a common driving voltage generating circuit 36 are supplied to the driving circuits 52 of the display layers 39B, 39G, and 39R.

FIGS. 6A to 6D show voltage waveforms applied to the scanning electrodes 48 and the signal electrodes 50 from the driving circuits 52 during one selection period (several ms to several tens ms). FIG. 6A shows a voltage waveform applied to the signal electrodes 50 to put the liquid crystal in the planar state. FIG. 6B shows a voltage waveform applied to the signal electrodes 50 to put the liquid crystal in the focal conic state. FIG. 6C shows a voltage waveform applied to selected scanning electrodes 48. FIG. 6D shows a voltage waveform applied to unselected scanning electrodes 48. FIG. 7A shows a voltage waveform applied to the liquid crystal layer of a pixel which is driven into the planar state. FIG. 7B shows a voltage waveform applied to the liquid crystal layer of a pixel which is driven into the focal conic state. FIG. 7C shows a voltage waveform applied to the liquid crystal layer of an unselected pixel.

At the pixel to be driven into the planar state, in the first half of the selection period, the voltage at the signal electrode 50 is +32 V as shown in FIG. 6A, and the voltage at the scanning electrode 48 is 0 V as shown in FIG. 6C. Therefore, a voltage of +32 V is applied to the liquid crystal layer of the pixel as shown in FIG. 7A. In the second half of the selection period, the voltage at the signal electrode 50 is 0 V, and the voltage at the scanning electrode 48 is +32 V. Therefore, a voltage of −32 V is applied to the liquid crystal layer of the pixel. Since the voltage applied in a non-selection period is +4 V or −4 V as shown in FIG. 7C, a pulse voltage of substantially ±32 V is applied to the liquid crystal layer of the pixel. Thus, the liquid crystal at the pixel enters the planar state. Since the cholesteric liquid crystal has memory characteristics, the planar state is maintained even after a pulse voltage is applied.

At the pixel to be driven into the focal conic state, in the first half of the selection period, the voltage at the signal electrode 50 is +24 V as shown in FIG. 6B, and the voltage at the scanning electrode 48 is 0 V. Therefore, a voltage of +24 V is applied to the liquid crystal layer of the pixel as shown in FIG. 7B. In the second half of the selection period, the voltage at the signal electrode 50 is +8 V, and the voltage at the scanning electrode 48 is +32 V. Therefore, a voltage of −24 V is applied to the liquid crystal layer of the pixel. Since the voltage applied in the non-selection period is +4 V or −4 V, a pulse voltage of substantially ±24 V is applied to the liquid crystal layer of the pixel. Thus, the liquid crystal at the pixel enters the focal conic state. Since the cholesteric liquid crystal has memory characteristics, the focal conic state is maintained even after a pulse voltage is applied.

A method of driving a display element in the present mode for carrying out the invention will now be described. In the present mode for carrying out the invention, no battery is provided, and received electric waves are used as a driving power source. When the display element having the display section provided by stacking the display layers utilizing a cholesteric liquid crystal is driven, the number of display layers to be simultaneously driven is varied depending on the strength of received electric waves. As a result, the display element has no operational failure even when the strength of the received electric waves is low, which allows writing for display to be performed in a preferable manner.

Figure 8:
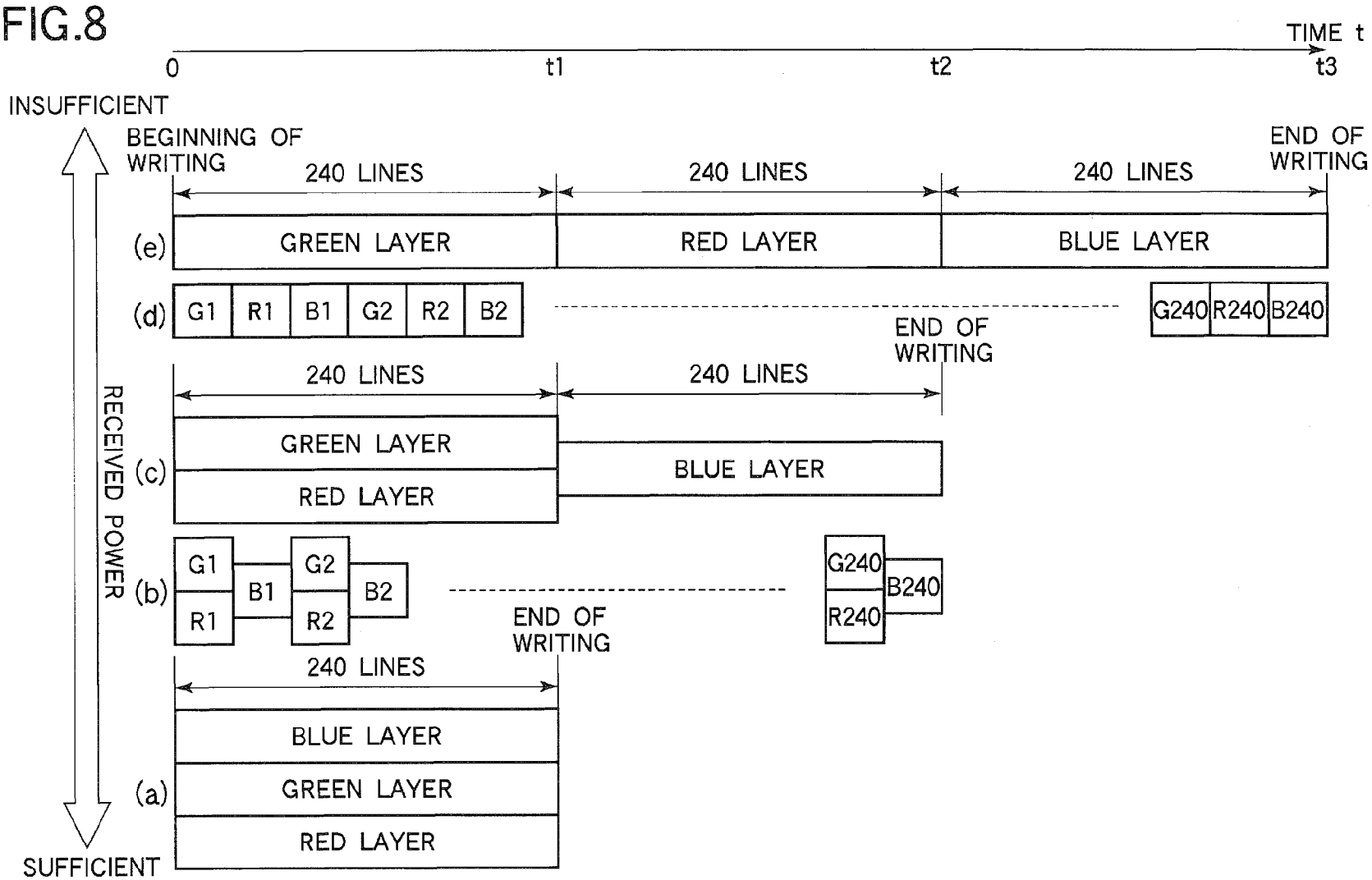
FIG. 8 is a illustration showing the principle of a method of driving a display element in the mode for carrying out the invention.

FIG. 8 shows the principle of the method of driving a display element in the present mode for carrying out the invention. Time is represented in the horizontal direction of the figure, and writing is started at a time 0. In the present mode for carrying out the invention, the three layers, i.e., the red layer (display layer 39R), the green layer (display layer 39G), and the blue layer (display layer 39B) are simultaneously driven as shown in FIG. 8(*a*) when the strength of received electric waves is high and received power is therefore sufficient (e.g., the received power is about 10 mW or more). The time spent from the beginning of writing of display data until the end of the write is a time t1 which is equivalent to scan time required for 240 lines. Let us assume that the power consumed to drive the red layer is about 2.8 mW; the power consumed to drive the green layer is about 3.0 mW; and the power consumed to drive the blue layer is about 3.3 mW. Then, power of about 9.1 mW is required for driving the three layers simultaneously. Power of about 10 mW is required when power required for other circuits is included.

When the received power is somewhat insufficient and it is therefore difficult to drive the three layers simultaneously (when the received power is, for example, about 7 mW), two (or one) is chosen as the number of layers to be driven simultaneously as shown in FIGS. 8(*b*) and (*c*). In the example shown in FIG. 8(*b*), two layers, i.e., the red layer and the green layer are first driven simultaneously to write display data for the first line (R1, G1). When the writing of display data for R1 and G1 is completed, only the blue layer is driven to write display data for the first line (B1). The red layer, the green layer, and the blue layer are alternately driven as thus described to write display data for up to the 240-th line.

In the example shown in FIG. 8(*c*), two layers, i.e., the red layer and the green layer are first driven simultaneously to write display data for all lines. When the writing for all lines is completed in the red layer and the green layer, only the blue layer is then driven to write display data for all lines. In this case, a user can have general understanding of display contents relatively early when display data are written with priority given to the layer of color having higher visibility. Since green, red, and blue have visibility which descends in the order in which the colors are listed, it is desirable to drive the red layer and the green layer first as in the present example.

At this time, it is advantageous for power saving to interrupt the supply of power to the layer other than the layers being driven. The power required to drive two layers, i.e., the red layer and the green layer simultaneously is about 5.8 mW, and the power required to drive only the blue layer is about 3.3 mW. Power consumption can be significantly reduced by reducing the number of simultaneously driven layers to two as thus described, and display data for the three layers can be written even when the received power is about 7 mW. The time spent from the beginning of the writing of display data until the end of the same is t2 (≈2×t1) which is required for scanning 480 lines. In the example shown in FIG. 8(*c*), however, display contents can be recognized at the time t1 when the writing is completed for all lines in the red layer and the green layer.

When the supply of received power is reduced further (when the received power is, for example, about 4 mW), the number of simultaneously driven layers is reduced to one as shown in FIGS. 8(*d*) and (*e*). In the example shown in FIG. 8(*d*), only the green layer is driven first to write display data for the first line (G1). When the writing of display data for G1 is completed, only the red layer is driven to write display data for the first line (R1). When the writing of display data for R1 is completed, only the blue layer is driven to write display data for the first line (B1). Thus, the green layer, the red layer, and the blue layer are sequentially driven to write display data for up to the 240th line.

In the example shown in FIG. 8(*e*), only the green layer is driven to write display data for all lines. When the writing of all lines is completed for the green layer, only the red layer is driven to write display data of all lines. When the writing of all lines is completed for the red layer, only the blue layer is driven to write display data of all lines. When driving is performed with priority to the layer of the color having higher visibility, a user can have general understanding of display contents relatively earlier.

Power consumption can be significantly reduced by driving the layers one at a time as thus described, and display data can be written in the three layers even when the received power is only about 4 mW. The time spent from the beginning of the writing of display data until the end of the same is t3 (≈3×t1) which is required for scanning 720 lines. In the example shown in FIG. 8(*e*), however, display contents can be recognized at the time t1 when the writing of all lines of the green layer is completed.

Figure 9:
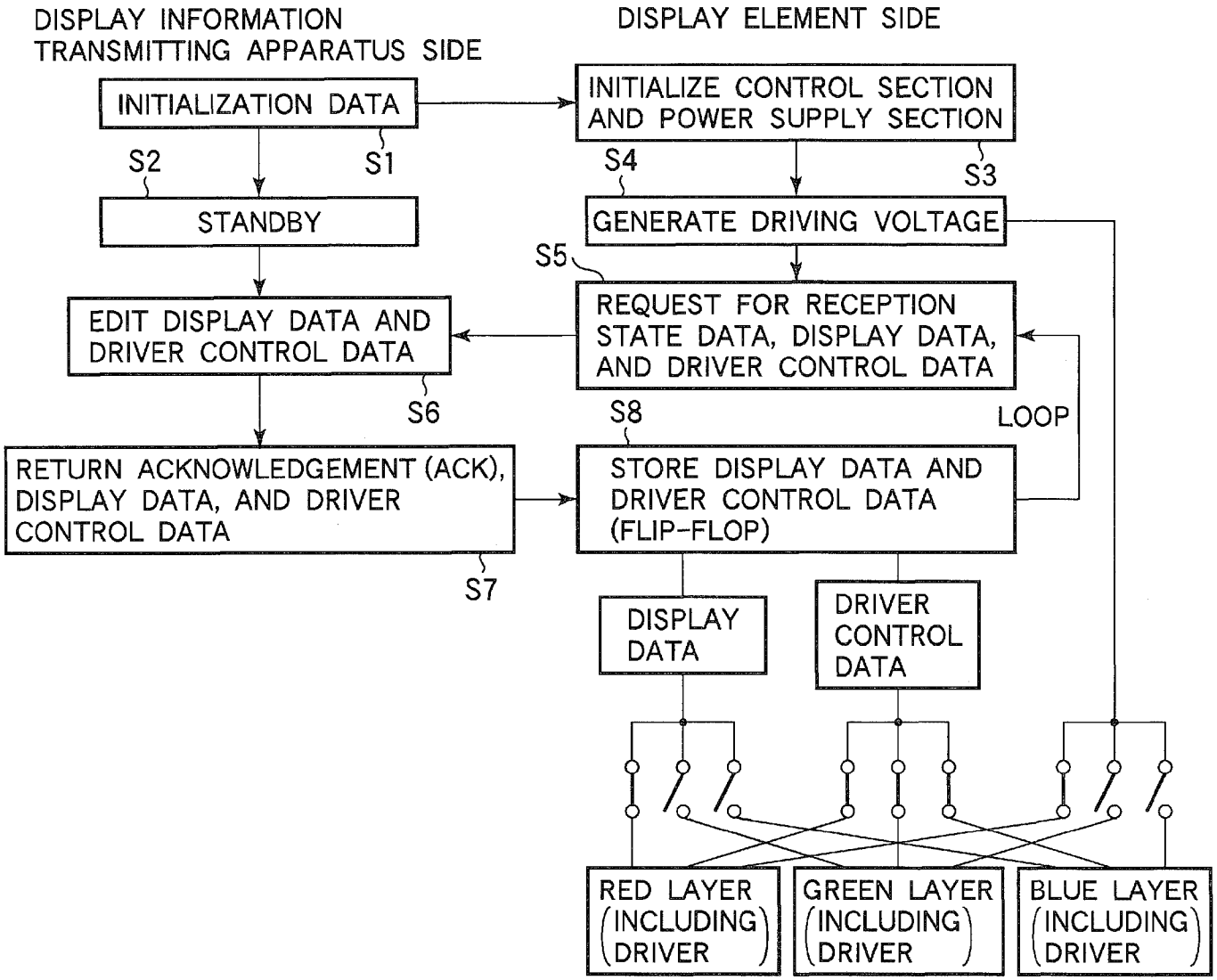
FIG. 9 is a diagram showing the method of driving a display element in the mode for carrying out the invention.

FIG. 9 is a diagram for explaining a method of driving a display element in the present mode for carrying out the invention. The present mode for carrying out the invention is based on an assumption that both of the step of "detecting" the display element 3 by putting the display element in the proximity of the display information transmitting apparatus 2 and the step of "mutual authentication" following the same have already been completed. As shown in FIG. 9, the display information transmitting apparatus 2 transmits electric waves including predetermined initialization data to the display element 3 (step S1) and enters a standby state thereafter (step S2). Upon receipt of the initialization data, the display element 3 initializes the control section 30 and the driving voltage generating circuit (power supply section) 36 (step S3). Next, the display element 3 generates a driving voltage from the received electric waves (step S4). Then, the display element 3 generates reception state data from the received electric waves and transmits a display data/driver control data request (REQ) signal to the display information transmitting apparatus 2 along with the reception state data thus generated (step S5).

Upon receipt of the reception state data and the display data/driver control data request (REQ) signal, the control section 20 of the display information transmitting apparatus 2 determines the number of layers to be driven simultaneously based on the reception state data. The display information transmitting apparatus 2 edits display data and driver control data based on the number of layers thus determined (step S6), returns an acknowledge (ACK) signal to the display element 2, and transmits the display data and driver control data to the display element 3 (step S7). Specifically, when the strength of the electric waves received at the display element 3 is high, the display information transmitting apparatus 2 transmits display data to the display element 3, the display data being a mixture of driver control data for simultaneously driving the three layers, i.e., the red layer, green layer, and the blue layer as shown in FIG. 8(*a*) and display data for the three layers. When the strength of the electric waves received at the display element 3 is low, the display information transmitting apparatus 2 transmits driver control data for driving two or one of the red layer, green layer, and the blue layer as shown in FIGS. 8(*b*) to (*e*) and display data for the two layers or one layer to be driven to the display element 3. For example, the driver control data include the data of a data fetching clock, data latch, scan shift, pulse polarity, and voltage output switch. For example, display data for one line are transmitted at a time.

Upon receipt of the driver control data and display data, the display element 3 stores both of the data in a flip-flop circuit (step S8). The control section 30 of the display element 3 selects the display layer(s) to be driven based on the driver control data and writes the display data for one line thus received in the selected display layer(s). It is desirable that the control section 30 of the display element 3 interrupts the supply of power to the unselected display layer(s).

When the writing of display data is completed, the process returns to step S5 at which the control section 30 of the display element 3 generates and transmits reception state data again. As a result, even if a change occurs in the state of reception during the writing of display data, display layers can be driven simultaneously according to a number of layers determined based on the reception state reflecting the change. When there is no change in the reception state, it is not essential to generate and transmit reception state data. Steps S5 to S8 are repeated for all lines to write display data in the three layers, i.e., the red layer, the green layer, and the blue layer. When the strength of electric waves received at the display element 3 becomes zero during writing of data, the display information transmitting apparatus 2 re-transmits the display data from halfway of the same based on the number of receptions of the REQ signal from the display element 3. As a result, when the communication is restarted, the display data can be written in the display element 3 starting at the part where writing has been interrupted.

In the above description, the number of display layers to be simultaneously driven is determined based on the state of reception of electric waves at the display element 3. Alternatively, the control section 20 of the display information transmitting apparatus 2 may determine the scanning speed of the display layers based on the strength of electric waves received at the display element 3. The power consumed to write display data in the display layers may be reduced also by reducing the scanning speed. Specifically, the scanning speed may be made lower as the strength of the received electric waves decreases, and the scanning speed may be made higher as the strength of the received electric waves increases.

Modifications of the display element and the method of driving the same in the present mode for carrying out the invention will now be described. In the case of display layers using cholesteric liquid crystals, it is difficult to make the layers completely equal in terms of voltage response characteristics as shown in FIG. 4 by using the same composition of liquid crystal or adjusting the cell gaps. However, when the voltage value of the driving pulse is varied between the layers for this purpose, the driving voltage generating circuit 36 will become complicated.

Figure 10A:
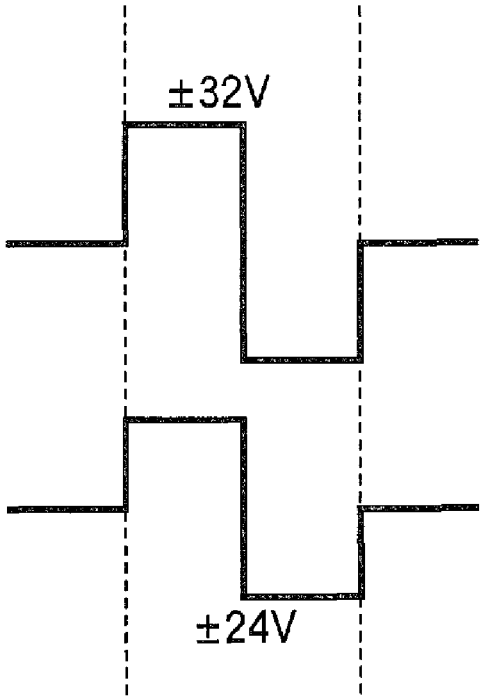
FIGS. 10A and 10B are diagrams showing a modification of the method of driving a display element in the mode for carrying out the invention.
Figure 10B:
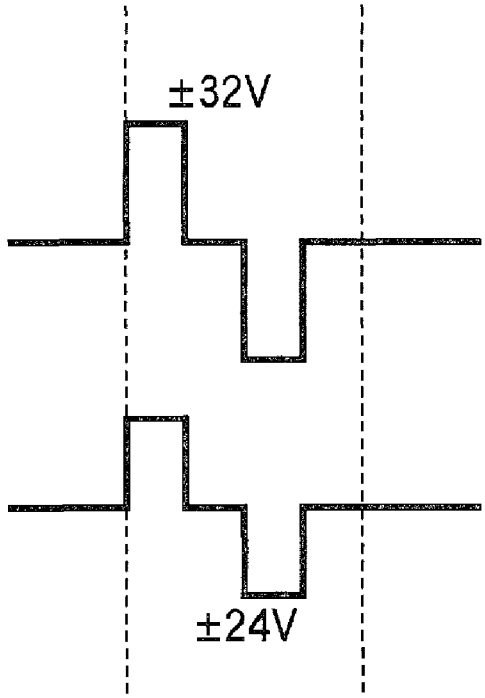

FIGS. 10A and 10B show waveforms of driving pulses applied to liquid crystal layers in this modification. FIG. 10A shows waveforms of driving pulses for a blue layer, and FIG. 10B shows waveforms of driving pulses for a green layer and a Red layer. In FIGS. 10A and 10B, driving pulses for putting the liquid crystal in the planar state are shown in the top part, and driving pulses for putting the liquid crystal in the focal conic state are shown in the bottom part. As shown in FIGS. 10A and 10B, a control section 30 of the display element in this modification drives the red layer, the green layer, and the blue layer using driving pulses having different duty ratios. Differences in voltage response characteristics can be compensated by varying the duty ratio of the driving pulses between the layers. For example, when the blue layer requires the highest driving voltage because of its characteristics, the driving pulse for the blue layer is provided with a duty ratio of 100% as shown in FIG. 10A. When the green layer and the red layer require a somewhat lower driving voltage, the duty ratio of the driving pulse for the green layer and the red layer is made lower than 100% without changing the voltage. When the driving voltage for the red layer is still lower than that for the green layer, the duty ratio of the driving pulse for the red layer may be made lower than that for the green layer. In this modification, since a common driving voltage generating circuit 36 can be used for the layers, differences between the layers in voltage response characteristics can be compensated without increasing the cost and power consumption.

Another modification of the method of driving a display element in the present mode for carrying out the invention will now be described. In display elements having a battery according to the related art, rewriting of display is commonly carried out by resetting the previous display throughout the display screen at a time. However, when an entire screen is reset at a time, power of at least several tens mW is consumed. For example, when a contactless IC card system is used, the power supplied from a reader/writer is 5 to 10 mW. Therefore, since the power required for resetting a screen at a time is considerably greater than the supplied power, it is difficult to reset the display element at a time without a battery.

Figure 11B:
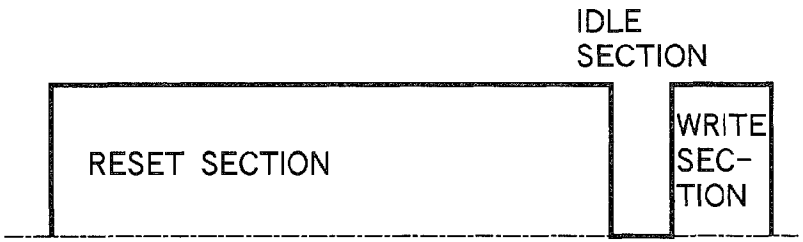
FIGS. 11A and 11B are illustrations showing another modification of the method of driving a display element in the mode for carrying out the invention.
Figure 11A:
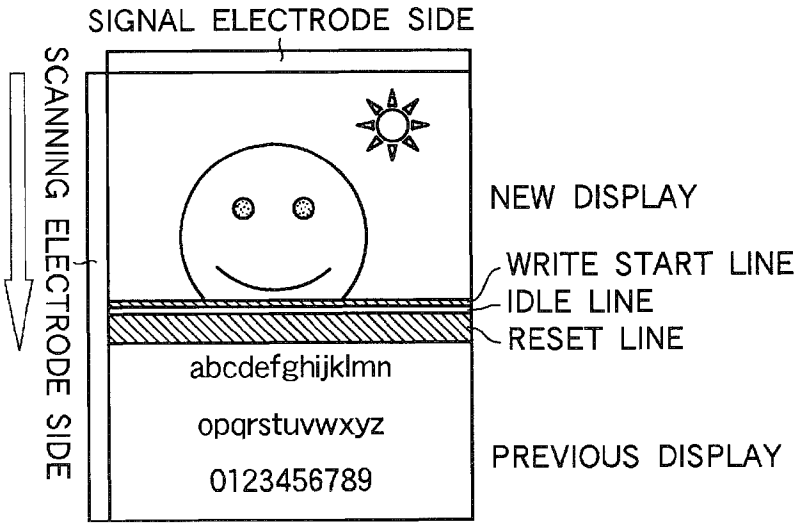
Figure 12B:
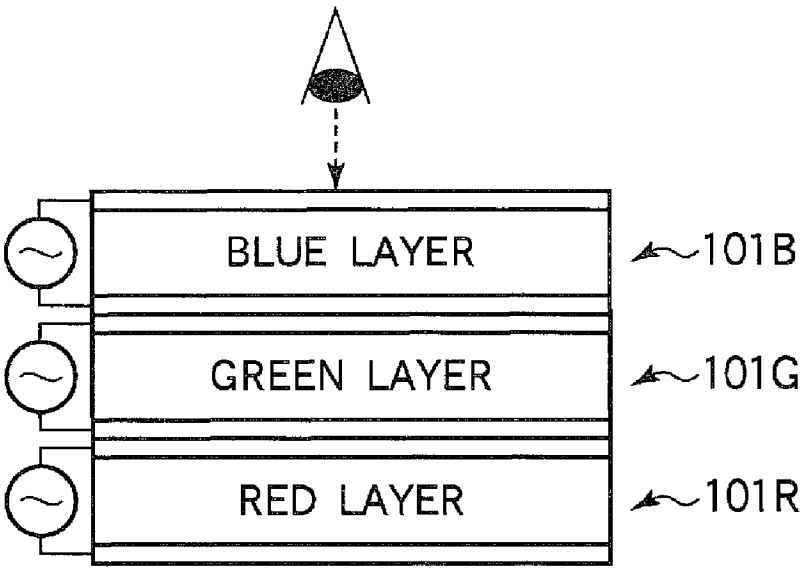
FIGS. 12A and 12B are illustrations schematically showing a configuration of a liquid crystal display element.
Figure 12A:
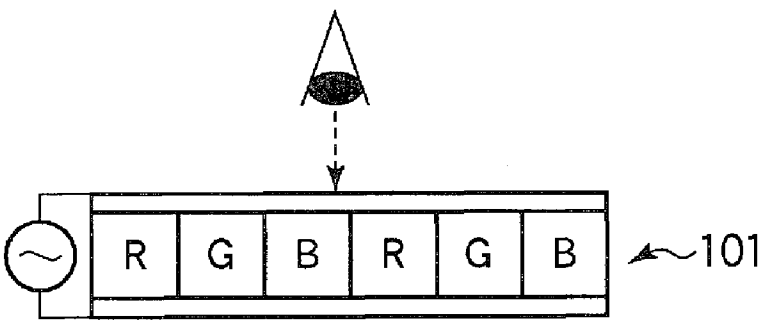

FIG. 11A shows a state of rewriting of a display screen of a display element carried out using the present modification, and FIG. 11B schematically shows the driving method of the present modification. In this modification, an operation of resetting several reset lines, e.g., four lines, and writing display data simultaneously in a write starting line (one line) adjoining the reset lines across an idle line (one line) as shown in FIGS. 11A and 11B is repeated until a number of lines is reached. When a screen is rewritten in such a manner, power consumption is smaller than when it is rewritten at a time. No special reset data, e.g., data for rendering all pixels in white, is used, and the display data written in the pixels of the write starting line is written as it is in the pixels of the reset lines to reset them.

In FIG. 11A, the lower half of the screen represents the screen which has been displayed previously, and the upper half represents the screen which is being newly displayed. The illustration represents a state in which the write start line or the write line proceeding one line at a time as described above has nearly reached the center of the screen after starting at the uppermost line. Data is written on this line, and reset lines, e.g., four lines are reset at the same time using the write data.

In the present modification, before display data is written at a pixel, the liquid crystal at the pixel is reset into the homeotropic state or focal conic state. Thus, display can be performed preferably at a high contrast while minimizing increase in power consumption.

A display element and a display information transmitting apparatus in the present mode for carrying out the invention were fabricated. A proximity contactless IC card of type-B was used as the display element. A reader/writer for contactless IC cards was used as the display information transmitting apparatus. When the display element was put close to the reader/writer at a distance of 1 cm or less, since there was sufficient power for driving, the R, G, and B layers were simultaneously written for display. When the display element and the reader/writer were then set at a distance of about 3 cm from each other, since the display element could not receive power sufficient to write the R, G, and B layers simultaneously for display, display writing was first performed for only the green layer, and the other two layers, i.e., the blue layer and the red layer were thereafter simultaneously written for display. Further, when the display element and the reader/writer were then set at a distance of about 5 cm from each other, the green layer, the red layer, and the blue layer were written for display in the order listed.

Wireless and battery-less writing could be similarly verified in systems other than type-B, e.g., type-C.

Further, the scanning speed can be varied. When there is sufficient power, writing can be performed at a scanning speed on the order of 3 ms/line when measured on the driving waveform. The scanning speed is lowered as the power decreases. The duty ratio of the driving pulse was set at 100% for the blue layer, 60% for the green layer, and 40% for the red layer in order to compensate differences between the driving voltages for the R, G, and B layers. Then, it was confirmed that compensation could be satisfactorily achieved.

As described above, in the present mode for carrying out the invention, a wireless and battery-less drive type display element utilizing a cholesteric liquid crystal can be stably driven while saving power. In the present mode for carrying out the invention, since an inexpensive general-purpose driver can be used, a reduction in manufacturing cost can be achieved. Further, the present mode for carrying out the invention makes it possible to perform partial rewriting of a screen at a high speed.

The invention is not limited to the above-described mode for carrying out the same and may be modified in various ways.

For example, while a display element utilizing a cholesteric liquid crystal has been described by way of example in the above-described mode for carrying out the invention, the invention is not limited to the same and may be applied to other types (e.g. electrophoretic) of display elements which are voltage-driven to provide memory characteristics. Above all, liquid crystal types are preferable for their physical stability.

What is claimed is:

1. A display apparatus comprising:

a display section provided by stacking a plurality of display layers;

a wireless transmitting/receiving section for receiving electric waves including display data of the plurality of display layers;

a driving voltage generating section generating a driving voltage from the received electric waves for driving the display layers; and a control section simultaneously driving the display layers in a number of said display layers determined based on a strength of reception of the electric wave by the driving voltage.

2. A display apparatus according to claim 1, wherein the lower the strength of reception of the electric waves is, the smaller the number of layers is.

3. A display apparatus according to claim 1, wherein the control section interrupts the supply of power to a display layer which is not driven.

4. A display apparatus according to claim 1, wherein the control section generates data on the reception strength of the electric waves and the wireless transmitting/receiving section transmits reception state data to outside.

5. A display apparatus according to claim 1, wherein the display layers comprise three layers displaying red, green, and blue, respectively.

6. A display apparatus according to claim 1, wherein the control section drives the display layer displaying a display color having high visibility earlier.

7. A display apparatus according to claim 1, wherein the control section drives the plurality of display layers using pulse voltages having duty ratios different from each other.

8. A display apparatus according to claim 1, wherein the display layers have memory characteristics.

9. A display apparatus according to claim 1, wherein the display layers include a pair of substrates and a liquid crystal enclosed between the substrates.

10. A display apparatus according to claim 9, wherein the liquid crystal is a liquid crystal which forms a cholesteric phase.

11. A display apparatus according to claim 1, wherein the display layers are driven using a simple matrix driving method.

12. A display apparatus according to claim 1, wherein the wireless transmitting/receiving section receives or transmits the electric waves which are in accordance with a wireless communication standard for contactless IC cards.

13. A display apparatus comprising:

a display section provided by stacking a plurality of display layers;

a wireless transmitting/receiving section receiving electric waves including display data of the plurality of display layers;

a driving voltage generating section generating a driving voltage from the received electric waves for driving the display layers; and a control section driving the display layers by the driving voltage at a scanning speed determined based on the strength of reception of the electric waves.

14. A display apparatus according to claim 13, wherein the lower the strength of reception of the electric waves is, the lower the scanning speed is.

15. A display apparatus driving method for driving a display apparatus having a display section wherein a plurality of display layers are stacked, based on electronic waves received from outside, comprising:

generating a driving voltage from the received electric waves for driving the display layers; and driving the display layers which are simultaneously driven by the driving voltage in a number of layers determined based on the strength of reception of the electric waves.

16. A method of driving a display apparatus according to claim 15, wherein when there is a change in the reception strength while the display layers are being driven, the display layers are simultaneously driven by the driving voltage according to a number of layers determined again based on the reception strength reflecting the change.

* * * * *